US005464003A

United States Patent [19]

Sherman

[11] Patent Number: 5,464,003

[45] Date of Patent: Nov. 7, 1995

[54] CROSSHAIR SUPPORT MEMBER FOR AN ARCHERY SIGHT

[76] Inventor: James R. Sherman, 710 B. Linden Ave., Lewiston, Id. 83501

[21] Appl. No.: 192,541

[22] Filed: Feb. 7, 1994

[51] Int. Cl.[6] ..... F41G 1/467

[52] U.S. Cl. ..... 124/87; 33/265; 124/80

[58] Field of Search ..... 124/87, 86, 80; 33/265; 24/535, 536, 569, 67.1; 403/314, 313, 310, 311, 309, 302, 300, 291

[56] References Cited

U.S. PATENT DOCUMENTS

| | | | |
|---|---|---|---|
| 508,587 | 11/1893 | Trumbull | 403/314 |
| 575,641 | 1/1897 | Gerard et al. | 403/314 X |
| 3,136,063 | 6/1964 | Stebbins | 124/87 |
| 3,670,422 | 6/1972 | Stebbins et al. | 33/265 |
| 4,136,462 | 1/1979 | Topel | 33/265 |
| 4,147,257 | 4/1979 | Zippel | 24/67.1 |
| 5,050,576 | 9/1991 | Larson | 124/87 |
| 5,131,153 | 7/1992 | Seales | 124/87 X |

FOREIGN PATENT DOCUMENTS

| | | | |
|---|---|---|---|
| 604233 | 8/1960 | Canada | 24/67.1 |

*Primary Examiner*—Anthony Knight

*Attorney, Agent, or Firm*—Wells, St. John, Roberts, Gregory & Matkin

[57] ABSTRACT

An archery sight having a frame for bow attachment. Pairs of crosshair support members on the frame support the ends of each crosshair. Each support member includes a main portion from which project spaced apart grips between which the end of a crosshair is inserted. The grips are supported by flexible webs. Edge surfaces on each web forcefully engage the sight frame upon tightening of a nut on the support member to flex the webs and displace the grips into gripping engagement with the end of the crosshair.

6 Claims, 1 Drawing Sheet

CROSSHAIR SUPPORT MEMBER FOR AN ARCHERY SIGHT

BACKGROUND OF THE INVENTION

The present invention pertains generally to weapon sights and particularly to a sight utilizing ribbon shaped fluorescent material as a crosshair.

In use are archery sights intended for use in low light conditions by reason of using crosshairs of fluorescent material. Such sights are desirable for the reason they are not dependent upon an artificial light source and hence prohibited by the game laws of certain states. Further, game animals taken with sights utilizing artificial light are not recognized by certain record books. Accordingly, the use of fluorescent ribbon-like material in archery sights is highly desirable but encounters a problem, namely, supporting the ends of a ribbon shaped piece of fluorescent material and attaching same to the base or frame of an archery sight.

One support member for a fluorescent crosshair is embodied in a slotted support within which a ribbon end segment is adhesively secured. As the crosshair is permanently mounted in its two supports there is no tolerance for variations in the distance between parallel frame members of a sight frame which can result in the crosshair sagging or flexing with the crosshair not being planar. Such a sight is, of course, inaccurate.

Another undesirable aspect of known sights using fluorescent ribbon material as crosshairs is in the machining of the crosshair supports which results in the supports being costly as each sight includes multiple supports.

SUMMARY OF THE PRESENT INVENTION

The present invention is embodied within a support member for a sight crosshair of ribbon configuration with the support member and ribbon in gripping engagement with one another.

The present crosshair support member is supported within the frame of a sight such as an archery sight for example utilizing ribbon shaped strips. Each support member, used in pairs, includes opposed, spaced surfaces which upon biasing close toward one another to grip a crosshair end segment. Surfaces of the support member are adapted for contact with the frame of the sight with the surfaces and frame cooperating to impart closing movement to grip portions of the support member between which is securely held the crosshair end. The support member includes adjustable means for urging the movable grips toward one another as by the use of nut elements in place on a threaded stud of the support member. Single nuts of each support member permit convenient adjustment of the nut to grip the crosshair in a manner assuring avoidance of sagging or buckling of the crosshair. In an unbiased condition the crosshair support member loosely receives the end segment of a crosshair, whereupon biasing of the support member into engagement with a sight frame results in closing movement of the support member grips to clamp the end segment. Frame engaging surfaces of the support member are located oppositely from the axis about which the grips move when the support member is tensioned.

Important objectives of the present invention include the provision of a sight having ribbon shaped crosshairs carried at their ends within support members in gripping engagement therewith; the provision of an archery sight permitting the user to compensate for the uneven expansion or contraction of metallic and non-metallic material to assure a sight crosshair being at all times in planar configuration for purposes of accuracy; the provision of a support member having grips oppositely disposed relative a ribbon end segment with the provision made for closing movement of the grip toward the end segment upon the support member being urged into contact with the frame of the sight.

DETAILED DESCRIPTION OF THE PREFERRED EMBODIMENTS

Figures 1, 1A, 1B, 2, 3, 4, 5:
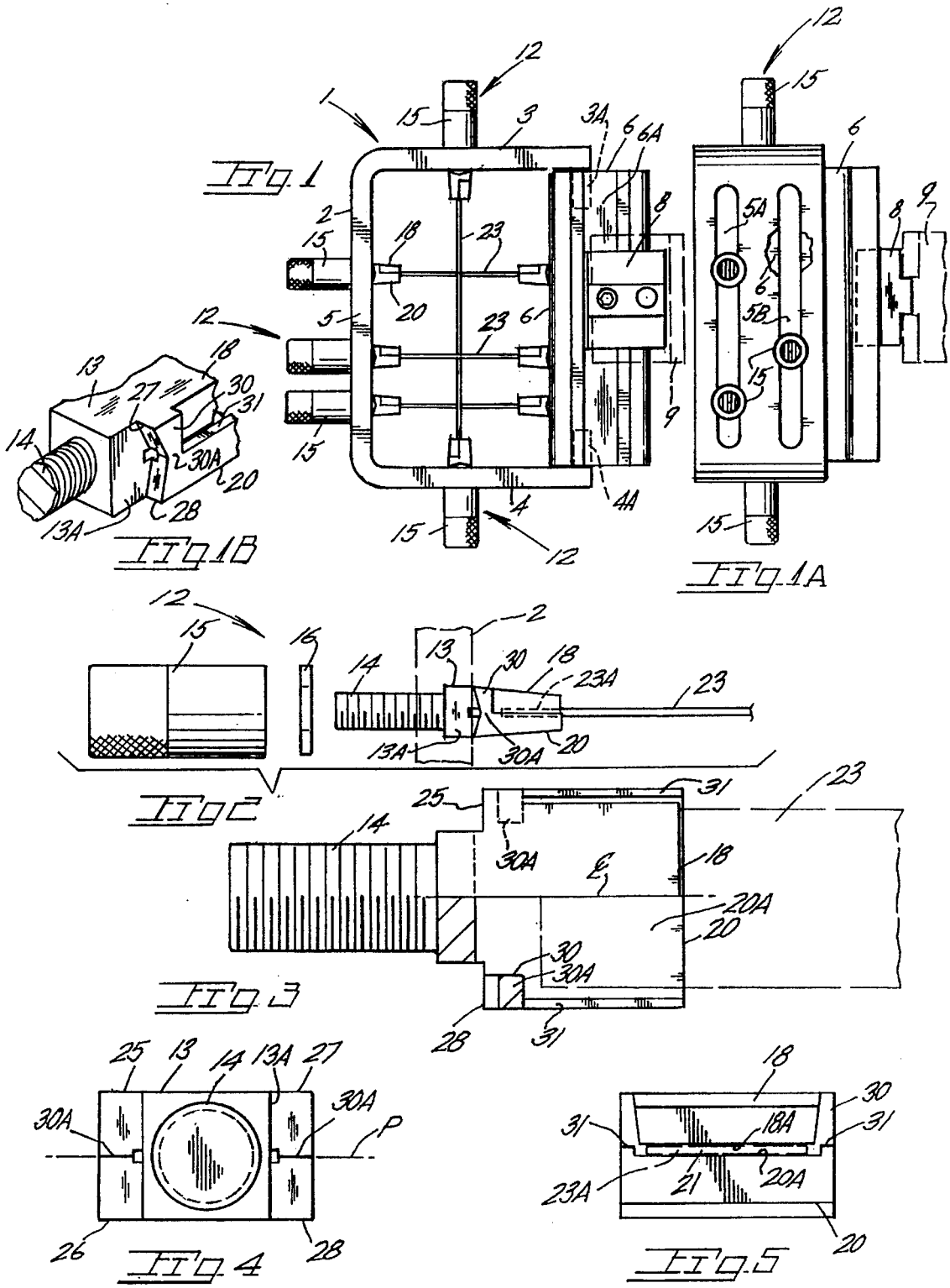
FIG. 1 is a front elevational view of an archery sight utilizing crosshair support members in gripping engagement with ribbon shaped crosshairs.
FIG. 1A is a side elevational view thereof taken from the left side of FIG. 1.
FIG. 1B is a fragmentary perspective of a support member.
FIG. 2 is an enlarged exploded view of a crosshair support member.
FIG. 3 is a plan view on an enlarged scale of a grip component of the crosshair support member.
FIG. 4 is a left end elevational view of FIG. 3.
FIG. 5 is a right end elevational view of FIG. 3.

With continuing attention to the drawings, the reference numeral 1 indicates generally a sight which may be an archery sight for installation on a bow.

The sight includes a frame 2 having top and bottom members 3 and 4, and an upright connecting member 5. A base 6 of the frame is located intermediate top and bottom members 3 and 4 and is secured thereto by fasteners extending through end flanges 3A–4A on the top and bottom members and through upper and lower portions of base 6. Said base includes a channel 6A within which is adjustably mounted a sight support block 8. An arm 9 which, when the sight is installed on a bow, includes means for securement to the riser of the bow. The upright member 5 and the base 6 each have two longitudinally oriented openings each of which define slots as at 5A–5B while additional slots in the frame are defined by top and bottom members 3 and 4. The frame is slotted for the purpose of slidably mounting later described support members supporting crosshairs of the sight, and particularly supporting preferred crosshairs of ribbon configuration having light collecting and emitting characteristics.

With attention now to the present support member, the same is indicated generally at 12 and includes a main body 13, having sides at 13A for sliding engagement with the frame edges defining slots as at 5A and 5B. A threaded stud 14 is integral with the main body and receives a nut 15 and a washer 16, the latter for abutment against the sight frame member. Integral with main body 13 are grip components or grips 18 and 20 with opposed surfaces 18A–20A which define an open area therebetween at 21, which is of slot-like configuration to permit insertion of an end segment 23A of a ribbon shaped crosshair 23. The inserted end segment 23A, located intermediate grip components 18 and 20, fits within the spaced apart grip components to permit end segment insertion and removal from the support member when the latter is an unbiased state.

For biasing the support member and specifically the grip components 18 and 20 thereof toward one another to close into gripping engagement with a crosshair end segment 23A, pairs of edges at 25 and 26 and 27 and 28 (FIG. 4) are provided on the grip components with the cooperating pairs of edges 25–26 and 27–28, being oppositely offset from a medial plane P of the support member. Being offset from medial plane P of the support member, the edges, when forcefully biased against the sight frame member, result in the opposed inner surfaces 18A–20A of grip components 18 and 20 being displaced toward medial plane P and into surface engagement with a crosshair end segment 23A inserted between the grip components. Hinge means for each grip 18–20 includes a web 30 is of a reduced cross section at 30A for flexing of web 30 when forces are applied to the edges 25–26 and 27–28. Tightening of nut 15 serves to draw the support member and specifically the edges 25–26 and 27–28 thereon into forceful engagement with surfaces of the sight frame.

To confine a crosshair end segment 23A against later displacement when the support member is in an unbiased or adjustable condition, a pair of raised shoulders at 31 are provided along opposite edges of grip component 20. The webs 30 are offset from main body 13 of the support member to provide the desired flexibility of the webs at their mid-points 30A in plane P in the presence of forces acting on edges 25–26 and 27–28 at the web extremities. Typically the fluorescent crosshair material is 0.012 of an inch with the hinge action permitting a reduction in the space 21 between the grip components adequate to firmy seat grip component surfaces 18A–20A into gripping engagement with a crosshair end segment therebetween. The crosshairs are securely held by the present support members when the nut elements 15 are tightened snugly into frame engagement to assure prevention of any slippage or sagging of the crosshairs or any rattle of same when the bow is shot.

A suitable fluorescent material is a transparent plastic colored by dyestuff manufactured and sold under the trademark LISA by the Mobay Corporation of Pittsburgh, Pa. Such transparent plastic, when treated with the dyestuff, provides a very bright edge surface utilized in the present instance as a crosshair usable in low light conditions. The crosshairs of the present sight may be provided in various colors to aid in proper crosshair selection for a target with vertically spaced, different colored crosshairs provided for different target ranges. The sight disclosed provides for a windage adjustment by the shifting of the uppermost and lowermost ribbon support members 12 to the right or left along their supporting frame members.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

1. A crosshair support member for attaching a crosshair to a sight having a ribbon shaped crosshair, the crosshair support member comprising, a main body, biasing means on said main body and engageable with said sight, first and second crosshair grips spaced from each other to receive an end segment of a crosshair therebetween, hinge means integral with each of said grips and said main body, and surfaces on said grips each for biased contact with the sight, said surfaces when biased by said biasing means moving said grips about said hinge means toward one another to grip the end segment of the crosshair.

2. The support member as recited in claim 1 wherein said surfaces are oppositely spaced from a medial plane of the support member.

3. The support member as recited in claim 1 wherein one of said grips includes opposing longitudinally oriented and raised ribbon shaped crosshair between the shoulders.

4. The support member as recited in claim 1 wherein said main body includes a slide for slidable engagement with said sight.

5. In a sight having ribbon shaped crosshairs in a frame, the improvement comprising, a ribbon support member including a main body, biasing means on said main body and engageable with said sight, first and second crosshair grips spaced from each other to receive an end segment of a crosshair therebetween, hinge means integral with each of said grips and said main body, and surfaces on said grips for biased contact with the sight, said surfaces when biased by said biasing means moving said grips about said hinge means toward one another to grip the end segment of the crosshair.

6. A crosshair support member for attaching a crosshair to a sight having a ribbon shaped crosshair, the crosshair support member comprising, a main body, biasing means on said main body and engageable with said sight, said biasing means including a threaded shaft first and second crosshair grips spaced from each other to receive an end segment of a crosshair therebetween, hinge means integral with each of said grips and said main body, and surfaces on said grips each for biased contact with the sight, said surfaces when biased by said biasing means moving said grips about said hinge means toward one another to grip the end segment of the crosshair.

* * * * *